United States Patent [19]

Franer

[11] 4,123,580

[45] Oct. 31, 1978

[54] COLOR SOURCE SHEET WITH RUBBER BINDER

[75] Inventor: Victor R. Franer, Roseville, Minn.

[73] Assignee: Minnesota Mining and Manufacturing Company, Saint Paul, Minn.

[21] Appl. No.: 809,320

[22] Filed: Jun. 23, 1977

[51] Int. Cl.[2] ..... B44D 1/18

[52] U.S. Cl. ..... 428/304; 250/318; 427/152; 428/320; 428/318

[58] Field of Search ..... 428/304, 320, 306, 318; 282/27.5; 427/152, 153; 250/317, 318; 96/33

[56] References Cited

U.S. PATENT DOCUMENTS

| | | | |
|---|---|---|---|
| 3,303,046 | 2/1967 | Chebiniak et al. | 428/320 |
| 3,647,503 | 3/1972 | Mitzutani et al. | 428/311 |
| 3,825,467 | 7/1974 | Phillips, Jr. | 428/320 |
| 3,906,138 | 9/1975 | Evensen | 428/320 |
| 4,021,595 | 5/1977 | Kiritani et al. | 282/27.5 |

*Primary Examiner*—William J. Van Balen

*Attorney, Agent, or Firm*—Cruzan Alexander; Donald M. Sell; Dean P. Edmundson

[57] ABSTRACT

A color source sheet consisting of a thin porous paper receptive to printing ink, typewriter, pencil copy, electrostatic copiers, etc. and having on one surface a thin uniform coating comprising rubber binder, particulate heat-volatilizable dye and particulate filler which is non-absorptive of the dye. The dye is transferable by thermographic heating at temperatures readily available in commercial thermographic copying machines.

5 Claims, No Drawings

COLOR SOURCE SHEET WITH RUBBER BINDER

BACKGROUND OF THE INVENTION

1. Field of the Invention

This invention relates to color source sheets useful in the thermographic production of color projection transparencies.

2. Description of the Prior Art

Color source sheets have been described in Newman, U.S. Pat. No. 3,147,377 and in Clark et al., U.S. Pat. No. 3,280,735. The intermediate sheets mentioned in Dybvig et al., U.S. Pat. No. 3,601,484 likewise serve as color source sheets in the color-printing process described therein. The above patents mention cellulose acetate, ethyl cellulose, polyvinyl-toluene and polystyrene as binders for the heat-volatilizable dyestuffs, and in proportions of two to three parts by weight of binder to one part of dye. Without the binder component, the dyes are difficult to uniformly apply and are easily removed by casual contact. However, in the presence of the binder, the temperature required to cause effective transfer of the dye is higher than desired, requiring operating at undesirably high temperatures. Many of the binder formulations are found to unduly adhere to the receptor sheets when heated in contact therewith; attempts to avoid sticking by incorporation of inert particulate fillers with hard resin materials have been found to permit lateral diffusion of dye at the interface, with resultant blurring of image outline.

SUMMARY OF THE INVENTION

It has now been found possible to produce a color source sheet having a uniform color-containing layer from which the color component is transferable by thermographic heating at temperatures readily available in commercial thermographic copying machines, with substantially no resultant adhesion between the source sheet and the receptor sheet and without any discernible blurring of the transferred image.

DESCRIPTION OF THE PREFERRED EMBODIMENT

Crude rubber, particularly when combined with resins and oils, has long been a favorite component of normally tacky and pressure-sensitive adhesives. Such adhesives bond to various surfaces with increasing ease when applied at increasingly elevated temperatures.

Surprisingly, I have now found that rubber-based binder compositions are particularly effective in the preparation of color source sheets capable of operating under temperature conditions normally used in thermographic copying machines. The dye-containing coating comes into substantially complete contact with the receptor sheet because of the inherent tackiness of the rubber so that lateral diffusion of dye vapors from the edges of the image areas is substantially avoided and, also, the rubber's tackiness aids in pre-imaging on the receptor by maintaining proper alignment between the donor and the receptor; yet the two sheets — after cooling to room temperature — are easily and completely separated by simple hand stripping. The dyestuff is readily liberated from the binder and the resultant image has a high color density and produces a good color image on the projection screen.

The following specific Example, with proportions given in parts by weight, unless otherwise indicated, will further illustrate the practice of the invention which, however, should not be construed as limited thereto.

EXAMPLE

| | | |
|---|---|---|
| A. | Binder composition | |
| | Crepe rubber | 83.77 |
| | Polyterpene resin ("Piccolyte S-115") | 9.24 |
| | Antioxidant ("Plastinox 2246") | 2.78 |
| | Mineral Oil ("American White Oil #31") - plasticizer | 4.21 |
| | Volatile solvent (Heptane) | 98.276 |
| | Liquifier (ethyl alcohol) | 1.724 |

The rubber is milled sufficiently to form a smooth bank on the rolls and is then dissolved, together with the resin, antioxidant and oil, in the heptane. The alcohol is subsequently added to reduce the viscosity of the solution.

Useful types of rubber in the present invention include all natural rubbers, acrylic polymers, butadiene-styrene copolymers, polybutene rubbers and other well known rubbers which are soluble in aliphatic hydrocarbon solvents such as heptane.

The polyterpene resin in the above formulation imparts additional tack to the rubber binder. Other useful tackifying resins include materials such as "Ester-Gum" (commercially available from Reichhold Chemicals), and "Flexalyn" (an ethylene glycol ester of rosin; commercially available from Hercules Powder Company).

Other useful plasticizers which may be used are those in which the heat-volatilizable dye is insoluble (or only sparingly soluble). Representative examples include castor oil, lanolin and paraffin oil.

| | | |
|---|---|---|
| B. | Dye concentrate | |
| | Binder composition | 15.675 |
| | Dye | 7.069 |
| | Cellulosic wood fibre (preferably sokafloc BW-200 produced by Brown Company of Berlin, New Hampshire having an average major dimension of about 15–35 microns) | 13.675 |
| | Diluent (Heptane) | 62.54 |
| | Alcohol | 1.04 |

The several components are mixed together in a ball mill until complete mixing is attained. The wood fibre is important from a dispensing standpoint in that it allows for better dye particle separation plus acting as a suspending agent — although being of a lighter density than clay and minerals, it doesn't absorb the dye color. In place of the cellulosic wood fiber it is possible to use a filler comprising quartz particles having an average size no greater than about 35 microns (preferably less than 10 microns). One representative example of this is "Min-U-Sil", commercially available from Penn. Glass Co.

Dyes which are found useful are those which are heat-volatilizable in the temperature range of about 70° C. to about 100° C. Useful representative dyes include DuPont Oil Blue or Oil Blue A, Calco Oil Yellow EM (available from American Cyanamid), Amaplast Red AAP (C.I. 60505), Intratherm Red (available from Crompton and Knowles), 4-tricyanovinyl-N,N-diethylaniline, and

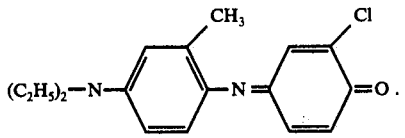

Each of these dyes sublimes at a temperature in the range of about 70° C. to 100° C. Mixtures of dyes may be used where individual heat-volatilizable dyes of desired color are not available.

| | | |
|---|---|---|
| C. | Coating composition | |
| | Dye concentrate B | 20.83 |
| | Binder composition A | 37.5 |
| | Heptane | 37.5 |
| | Alcohol | 4.17 |

The non-volatile components constitute approximately 5½ percent of the final composition.

D. Carrier

A thin porous paper, calendered on one surface and having a ream weight (500 − 24 × 36) of 18 lbs., serves as a preferred carrier or backing.

The coating composition is applied by spreading in a uniform layer and rapidly drying in a current of warm air. The coating weight after drying is 2.95 lbs. per ream. Penetration of the paper by the coating composition is substantially avoided, providing a sharp contrast in color from the coated side to the uncoated side of the porous paper.

The dye component remains largely if not wholly undissolved and is present in the dried coating in the form of finely divided discrete particles. As a result, the color of the coated sheet does not necessarily represent the color of the image formed therefrom; for example, a sheet prepared with DuPont Oil Blue has a dull greenish tinge, but produces a clear intense bright blue image by thermographic transfer.

In the present invention the amounts of the various components of the coating may vary. Generally speaking the various components are present in the ranges listed below, where the percentage figures refer to percent by weight based on the weight of the coating:

| | Percentage |
|---|---|
| Rubber | 20 to 50% |
| Antioxidant | Up to 5% |
| Plasticizer | 0 to 5% |
| Tackifying resin | 0 to 10% |
| Dye | 10 to 35% |

-continued

| | Percentage |
|---|---|
| Particulate filler | 10 to 60% |

A preferred receptor sheet (for use with the color source sheet of the invention) coonsists of a heat-resistant transparent film base such as Eastman Kodak Company's "Kodacel" TA 401 triacetate. Another preferred receptor sheet comprises a conventional polyester film carrying a thin continuous surface coating of vinyl resin ("Vinylite VYNW") containing a very small proportion (about two to three percent) of nickel octoate. Analogous coatings have previously been described, e.g. in Evensen U.S. Pat. No. 3,906,138. It is preferable, but not essential, for the receptor sheet to have a top coat over the vinyl resin surface coating containing a cellulose acetate butyrate 0.08 grams/sq. ft. dry to prevent heat marking of the softer vinyl resin coating. The top coating may be formed from the following composition, for example:

| | |
|---|---|
| Toluene | 48.75 |
| Cellulose Acetate Butyrate (Eastman Kodak 171-25) | 2.5 |
| Acetone | 48.75 |

The foregoing examples are illustrative of the materials useful in the present invention. Other variants are possible without departing from the scope of this invention.

What is claimed is:

1. A color source sheet consisting of a thin porous paper having on one surface a thin uniform coating comprising a rubber binder in which is dispersed particulate heat-volatilizable dye and a particulate filler which is non-absorptive of said dye, wherein said particulate filler has a major dimension no greater than about 35 microns.

2. A color source sheet in accordance with claim 1, wherein said particulate filler is selected from cellulosic wood fiber and quartz particles.

3. A color source sheet in accordance with claim 1 wherein said dye is present in an amount of about 10 to 35% by weight based on the weight of said coating.

4. A color source sheet in accordance with claim 1 wherein said rubber comprises natural rubber and there is included a polyterpene resin in an amount no greater than about 10% by weight based on the weight of said coating.

5. A color source sheet in accordance with claim 1, wherein said rubber binder is present in an amount of about 20 to 50% by weight, said dye is present in an amount of about 10 to 35% by weight, and said particulate filler is present in an amount of about 10 to 60% by weight, based on the weight of said coating.

* * * * *